US005416572A

United States Patent [19]

Kolb et al.

[11] Patent Number: 5,416,572

[45] Date of Patent: May 16, 1995

[54] CLEANING APPARATUS FOR AN ELECTROPHOTOGRAPHIC PRINTING MACHINE

[75] Inventors: Steven E. Kolb, Penfield; John C. DeMott; Carl F. Oresick, both of Rochester, all of N.Y.

[73] Assignee: Xerox Corporation, Stamford, Conn.

[21] Appl. No.: 176,990

[22] Filed: Jan. 3, 1994

[51] Int. Cl.[6] ..... G03G 21/00

[52] U.S. Cl. ..... 355/299; 355/215; 355/301

[58] Field of Search ..... 355/299, 296, 297, 301, 355/302, 303, 215

[56] References Cited

U.S. PATENT DOCUMENTS

| | | | |
|---|---|---|---|
| 3,879,124 | 4/1975 | Eppe et al. | 355/302 |
| 4,819,031 | 4/1989 | Thayer et al. | 355/298 |
| 4,989,047 | 1/1991 | Jugle et al. | 355/297 |
| 4,999,679 | 3/1991 | Corbin et al. | 355/303 |
| 5,031,000 | 7/1991 | Pozmakas et al. | 355/297 |

FOREIGN PATENT DOCUMENTS

| | | | |
|---|---|---|---|
| 62-94884 | 5/1987 | Japan | 355/303 |

*Primary Examiner*—A. T. Grimley
*Assistant Examiner*—Nestor R. Ramirez
*Attorney, Agent, or Firm*—Leslie A. Weise

[57] ABSTRACT

An agglomerate spot cleaning blade is supported to cleaning housing, thereby forming a substantially enclosed chamber, in sealing engagement with respect to the photoreceptor surface. Contact is maintained between a cleaning brush, located within a cleaning housing, and a blade, whereby rotating brush fibers remove accumulated agglomerate debris particles from the blade. A substantially air-flow free environment is maintained for removal of residual toner and debris from the photoreceptor surface and the blade, without the need for a separate vacuum/air removal system assist, or a separate manual maintenance step.

14 Claims, 3 Drawing Sheets

CLEANING APPARATUS FOR AN ELECTROPHOTOGRAPHIC PRINTING MACHINE

FIELD OF THE INVENTION

This invention relates generally to a reproduction apparatus, and more particularly to a cleaning apparatus for removing residual toner and debris from a charge retentive surface including a secondary cleaning system for release and removal of agglomerate particles from the surface that are not cleaned therefrom at the primary cleaner.

BACKGROUND OF THE INVENTION

In electrophotographic applications, a charge retentive surface (e.g. photoconductor, photoreceptor, or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways, such as by a modulated laser beam.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin, adhesives and other debris have a tendency to be attracted to the charge retentive surface. It is essential for optimum operation that the toner remaining on the surface be cleaned thoroughly therefrom.

A commercially successful mode of cleaning employed hereinbefore in electrophotographic printing machines utilizes a brush with conductive fiber bristles which have suitable triboelectric characteristics to remove residual toner particles from the charge retentive surface. A voltage is applied to the fibers to enhance removal of toner from the charge retentive surface.

However, not all toner and debris is removed from the surface by the brush cleaner. It has been found that toner particles agglomerate with themselves, and with certain types of debris to form a spot-wise deposition that can eventually strongly adhere to the charge retentive surface. These spots range from 50 $\mu$m to 500 $\mu$m in diameter, but typically are about 200 $\mu$m in diameter. The agglomerate debris particles range in material compositions from strictly toner to a broad assortment of toner, adhesives, and plastics and debris from paper. The spots cause a copy quality defect showing up as a black spot on a background area of the copy which is the same size as the spot on the photoreceptor. The spot on the copy varies slightly with the exact machine operating conditions, but cannot be deleted by control of the the machine process characteristics. The presence of agglomerate spots tends to be particularly predominant with the use of recycled-content paper in the printing machine, as more paper debris is often present on recycled-content paper than on non-recycled content paper. Also, the need for effective agglomerate spot removal may be more critical with the use of recycled-content paper because pre-existing spots often appear on the surface of this type of paper which remain after the image has been transferred. In studying the formation of these spots, it was noted that most of the spots appeared instantaneously on the charge retentive surface, i.e., most spots were not the result of a continuing nucleation process. It was subsequently noted that newly deposited spots were more weakly adhered to the surface than older spots.

Agglomerate spot cleaning blades ("spots blades") have been used for removal of agglomerate particles from a charge retentive surface, wherein a relatively lower load is applied to the blade so that the various problems associated with the frictional sealing contact that must occur in the normal cleaning engagement of blades with a charge retentive surface are avoided. Prior art systems wherein a spots blade is used in conjunction with a primary cleaner have utilized an air stream/vacuum removal system for removal of the agglomerate particles accumulated by the spots blade. In some cases, if an air stream/vacuum removal system has not been incorporated in the design of the machine for such removal, a periodic maintenance step is required for manual removal of the accumulated particles from the spots blade.

The following disclosures may be relevant to various aspects of the present invention and may be briefly summarized as follows:

U.S. Pat. No. 4,989,047 issued to Jugle et al. discloses an apparatus for cleaning an electrophotographic printer imaging surface. The cleaning apparatus includes a primary cleaner device in combination with a secondary cleaning device. The secondary cleaning device consists of a blade holder pivotally connected to the housing. The blade holder holds a cleaning blade in frictional contact with the imaging surface, arranged at a low angle of attack and to which a relatively low load is applied for the removal of toner and other debris agglomerates. An air flow path is described to assure that the air stream caused by movement of the brush and a vacuum collection arrangement removes collected agglomerate particles from the spots blade.

U.S. Pat. No. 5,031,000 issued to Pozniakas discloses a floating support assembly which enables the secondary cleaning blade to float relative to the charge retentive surface. This floating support assembly is loaded with a weight selected to maintain the blade in contact with the charge retentive surface, and has a stop to limit the range of movement of the floating blade. An air stream is disclosed for removal of accumulated agglomerate particles from the spots blade, and alternatively, manual removal of the agglomerate particles by periodic maintenance is disclosed.

U.S. Pat. No. 4,819,031 issued to Thayer et al. discloses a multi-vaned toner removal member for transport of toner removed from the photoreceptor belt surface by a primary cleaning blade. The vanes, or blades, mechanically remove toner accumulated by the cleaning blade and transport toner to an auger arrangement.

SUMMARY OF THE INVENTION

In accordance with the invention, and in accordance with one aspect of the invention, there is provided an improved printing machine of the type having a latent image recorded on a surface which is developed with toner. The improvement comprises a housing defining an open end adjacent to the surface. A brush is rotatably supported within the housing and in contact with the surface for removing toner and debris therefrom. A blade is adapted to remove toner and debris from the surface. The brush is in contact with the blade so that toner and debris removed from the surface by the blade, is then removed from the blade by the brush. The blade is supported on the housing adjacent to the open end to form a substantially continuous surface with the housing in a sealing engagement with the surface wherein a substantially air-flow free environment is maintained within the housing.

Pursuant to another aspect of the invention, a cleaning apparatus is provided for the removal of spot-causing agglomerate particles from a charge retentive surface. The cleaning apparatus comprises a substantially closed housing defining an open end adjacent to the surface. A brush is rotatably supported within the housing and in contact with the surface for removing toner and debris particles therefrom. A blade is adapted to remove toner and debris particles from the surface. The brush is in contact with the blade so that toner and debris particles removed from the surface by the blade, are then removed from the blade by the brush. The blade is supported on the housing adjacent to the open end to form a substantially continuous surface with the housing in a sealing engagement with the surface wherein a substantially air-flow free environment is maintained within the housing.

DETAILED DESCRIPTION

While the present invention will hereinafter be described in connection with a preferred embodiment, it will be understood that it is not intended to limit the invention to that embodiment. On the contrary, it is intended to cover all alternatives, modifications, and equivalents, as may be included within the spirit and scope of the invention as defined by the appended claims.

Figure 3:
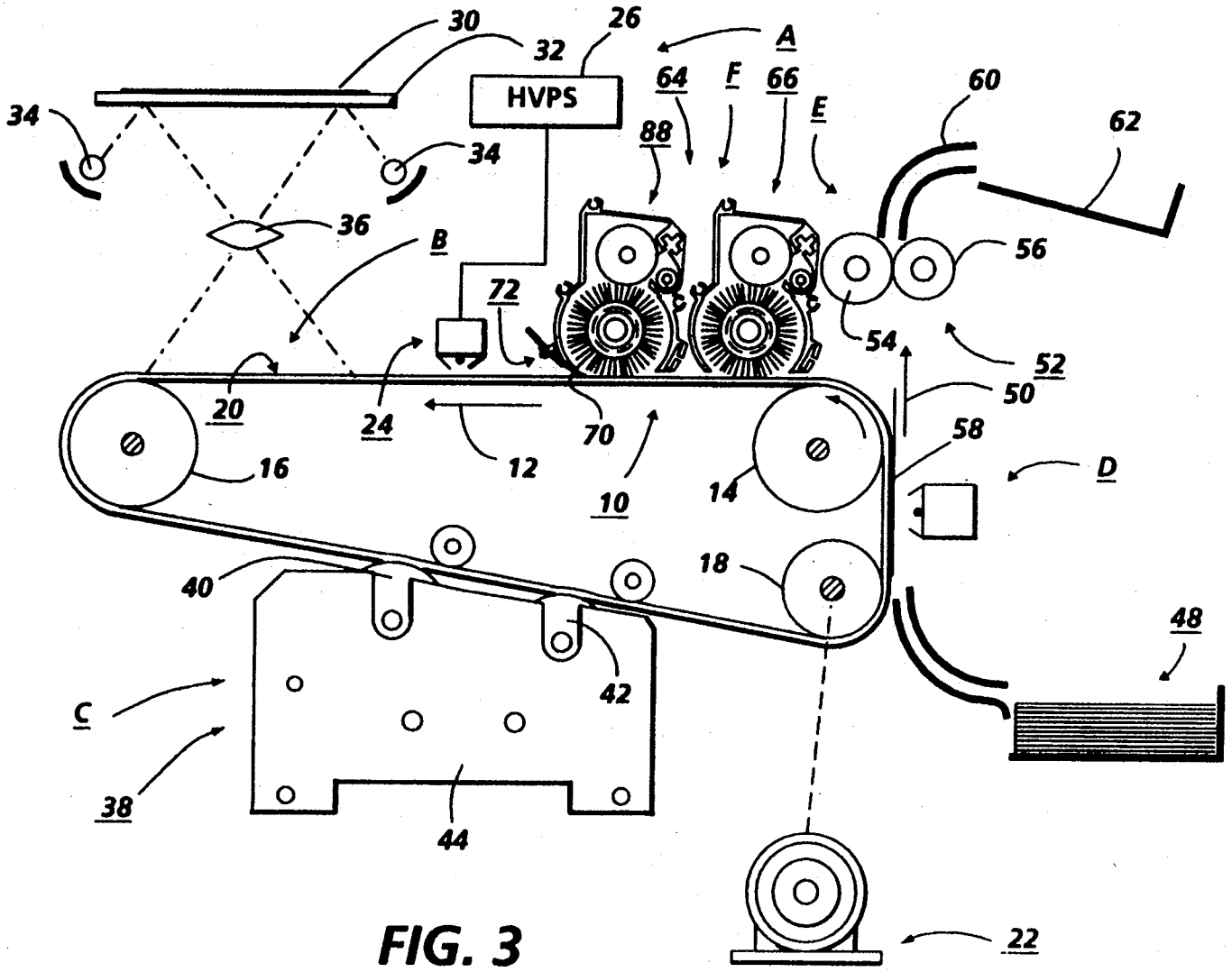
FIG. 3 is a schematic elevational view depicting an electrophotographic printing machine incorporating the present invention.

For a general understanding of the features of the present invention, reference is made to the drawings where like reference numerals have been used throughout to identify identical elements. FIG. 3 will be described only briefly. It will no doubt be appreciated that the various processing elements also find advantageous use in electrophotographic printing applications from an electronically stored original, in apparatus having both printing and copying capabilities, or, with appropriate modifications, to an ion projection device which deposits ions in image configuration on a charge retentive surface.

A reproduction machine in which the present invention finds advantageous use utilizes a photoreceptor belt 10 having a photoconductive (or imaging) surface 20. Belt 10 moves in the direction of arrow 12 to advance successive portions of the belt sequentially through the various processing stations disposed about the path of movement thereof.

Belt 10 is entrained about stripping roller 14, tension roller 16, and drive roller 18. Drive roller 18 is mounted rotatably in engagement with belt 10. Motor 22 rotates roller 18 to advance belt 10 in the direction of arrow 12. Both stripping roller 14 and tension roller 16 are rotatably mounted. These rollers are idlers which rotate freely as belt 10 moves in the direction of arrow 12.

With continued reference to FIG. 3, initially a portion of belt 10 passes through charging station A. At charging station A, excitation of power supply 26 causes corona generating device 24 to charge photoreceptor belt 10 to a relatively high, substantially uniform negative potential. After photoconductive surface of belt 10 is charged, the charged portion thereof is advanced through exposure station B.

At exposure station B, an original document 30 is positioned face down on a transparent platen 32 for illumination with flash lamps 34. Light rays reflected from the original document 30 are reflected through a lens 36 and projected onto a charged potion of photoreceptor belt 10 to selectively dissipate the charge thereon. An electrostatic latent image is then recorded on the belt which corresponds to the informational area contained within the original document. By way of example, if corona generator 24 has charged the photoconductive surface to a negative potential, the electrostatic latent image will have a negative potential. It will also be understood that a laser may be used instead of the light lens imaging system to imagewise discharge the photoreceptor in accordance with stored electronic information.

Thereafter, belt 10 advances the electrostatic latent image to development station C. At development station C, a magnetic brush developer unit 38 advances a developer mix (i.e. toner and carrier granules) into contact with the electrostatic latent image. Preferably, magnetic brush developer unit 38 includes two magnetic brush developer rollers 40 and 42. Rollers 40 and 42, mounted within developer housing 44, advance developer material into contact with the latent image. These developer rollers form a brush of carrier granules and toner particles extending outwardly therefrom. The "right sign" toner particles are positively charged while the "wrong sign" toner particles are negatively charged. The latent image attracts the toner particles from the carrier granules, thereby forming toner powder images on photoreceptor belt 10. Ideally, only the positively charged toner particles are attracted to the photoconductive surface. However, some "wrong sign" or negatively charged toner particles are also attracted to the photoconductive surface.

Belt 10 then advances the developed latent image to transfer station D. At transfer station D, a sheet of support material such as a paper copy sheet is moved into contact with the developed latent image on belt 10 from a sheet feeding apparatus, indicated generally by reference number 48. After transfer, the sheet continues to move in the direction of arrow 50 onto a conveyor (not shown) which advances the sheet to fusing station E.

Fusing station E includes a fuser assembly, indicated generally by the reference numeral 52, which permanently affixes the transferred toner powder images to the sheets. Preferably, fuser assembly 52 includes a heated fuser roller 54 adapted to be pressure engaged with a back-up roller 56 with the toner powder images contacting fuser roller 54. In this manner, the toner powder image is permanently affixed to the sheet. After fusing, sheet 58 advances through chute 60 to catch tray 62 for subsequent removal from the printing machine by the operator.

After the copy sheet is separated from photoconductive surface of belt 10, the positively and negatively charged residual toner particles adhering to photoconductive belt surface are removed therefrom at cleaning station F. Cleaning station F includes a cleaning apparatus, indicated generally by the reference numeral 64 having a pair of cleaning units 66 and 88. The cleaning units 66 and 88 differ generally in that cleaning unit 88 has an agglomerate spot cleaning blade 70 which is integrally attached to a housing by a blade support assembly 72. Furthermore, cleaning unit 66 is adapted to remove positively charged particles from photoconductive surface 20, with cleaning unit 88 being adapted to remove negatively charged residual particles therefrom as well as agglomerate particles collected by the spots blade. Further details of cleaning apparatus 64 will be described hereinafter with reference to FIG. 1. Subsequent to cleaning, a discharge lamp (not shown) floods photoconductive surface 20 with light to dissipate any residual electrostatic charge remaining thereon prior to the charging thereof for the next successive imaging cycle.

As thus described, a reproduction machine in accordance with the present invention may be any of several well known devices. Variations may be expected in specific processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein.

Figure 1:
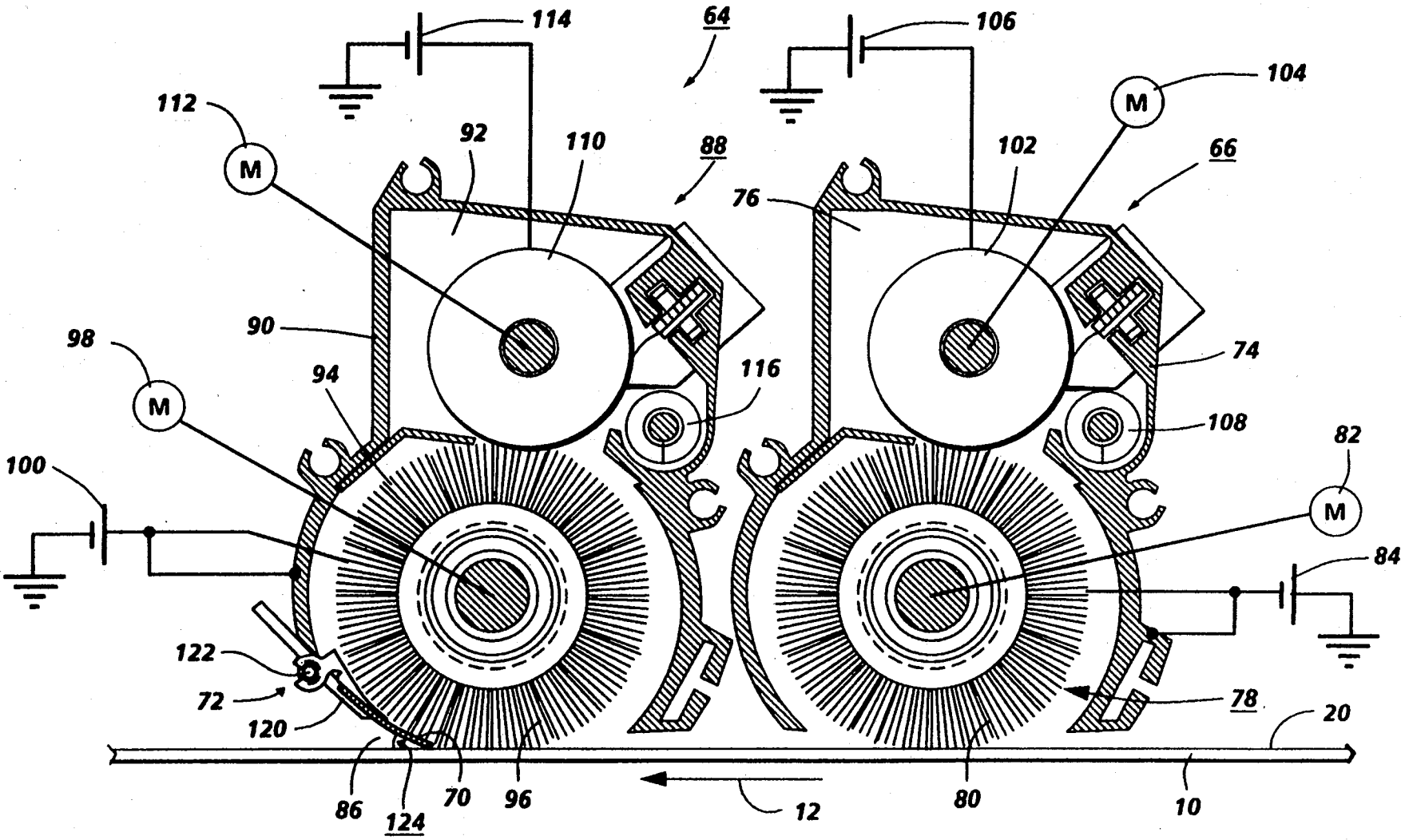
FIG. 1 is an enlarged view of an embodiment of the cleaning station of the present invention.

Referring now to FIG. 1, and in accordance with one embodiment of the invention, there is shown cleaning apparatus 64 in greater detail. As shown thereat, cleaning apparatus 64 includes cleaning unit 66 and cleaning unit 88. Each cleaning unit 66 and 88 respectively includes a substantially closed housing 74 and 90, having an open end adjacent to the photoreceptor surface 20, defining a chamber 76 and 92, and and having a cleaning brush 78 and 94, disposed therein. Cleaning brushes 78 and 94 include conductive fibers 80 and 96 extending outwardly from a cylindrical core. Preferably, cleaning brushes 78 and 94 are made from an aluminum core with the conductive fibers being made from a polyamide, such as Nylon, a trademark of the DuPont Corporation. The conductive fibers 80 and 96 have a pile height of about ¾ of an inch and a pile fiber fill density of about 30,000 fibers per square inch of 7 to 25 denier per filament fibers. Constant speed motors 82 and 98 respectively rotate brushes 78 and 94 at a substantially constant angular velocity. Voltage sources 84 and 100 respectively apply a D.C. voltage to cleaning brushes 78 and 94.

With specific reference to cleaning unit 66, voltage source 84 electrically biases cleaning brush 78 to preferably about −400 volts. In this way, an electrical field is established between photoconductive surface 20 and brush 78 so that the positively charged residual particles adhering to photoconductive surface 20 of belt 10 are attracted to cleaning brush 78. In operation, driven by constant speed motor 82, the brush 78 rotates at a constant angular velocity, and the conductive fibers 80 of brush advance into contact with photoconductive surface 20 of belt 10. The positively charged particles adhering to belt 10 are attracted to the conductive fibers 80 of cleaning brush 78. Roller 102 is positioned closely adjacent to cleaning brush 78. A constant speed motor 104 rotates roller 102. As roller 102 rotates, it attracts the particles from the conductive fibers of cleaning brush 78. Voltage source 106 is connected to roller 102 and applies a D.C. voltage preferably of about −650 volts thereon. The magnitude of the electrical bias applied by voltage source 106 to roller 102 is greater than the electrical bias applied by voltage source 106 to the conductive fibers 80 of cleaning brush 78. Preferably, roller 102 is made from aluminum having a coating of aluminum oxide thereon. A blade is positioned closely adjacent to roller 102 to remove the positively charged particles therefrom. The particles removed from roller 102 are received by a helical auger 108. Helical auger 108 removes the particles from the cleaning apparatus.

With continued reference to FIG. 1, cleaning unit 88 is adapted to remove the negatively charged particles from belt 10. A voltage source 100 electrically biases cleaning brush 94 to preferably about +300 volts. In this way, an electrical field is established between photoconductive surface 20 and brush 94 so that the negatively charged residual particles adhering to photoconductive surface 20 of belt 10 are attracted to cleaning brush 94. In operation, driven by constant speed motor 98, the brush 94 rotates at a constant angular velocity, and the conductive fibers 96 of brush advance into contact with photoconductive surface 20 of belt 10. The negatively charged particles adhering to belt 10 are attracted to the conductive fibers 96 of cleaning brush 94. An agglomerate spot cleaning blade 70 is integrally attached to side of housing 90 by a blade support assembly 72. The spots blade is advantageously positioned immediately adjacent to opening 86 between housing 90 and photoreceptor surface 20, so that the spots blade and support assembly form an integral extension of the surface of cleaning housing, thereby enclosing the housing in a sealing engagement with the photoreceptor belt surface wherein a substantially air-flow free environment is maintained within housing 90. The spots blade 70 is in contact with cleaning brush 94 such that agglomerate debris particles accumulated by the spots blade are swept by rotating brush fibers 96 and collected with the negatively charged particles from belt surface 20. Both the mechanical and the electrostatic properties of brush fibers may facilitate in removal of the agglomerate particles.

Roller 110 is positioned closely adjacent to cleaning brush 94. A constant speed motor 112 rotates roller 110. As roller 110 rotates, it attracts the particles from the conductive fibers 96 of cleaning brush 94. Voltage source 114 is connected to roller 110 and applies a D.C. voltage preferably of about +550 volts thereon. The magnitude of the electrical bias applied by voltage source 114 to roller 110 is greater than the electrical bias applied by voltage source 100 to the conductive fibers 96 of cleaning brush 94. Preferably, roller 110 is mace from aluminum having a coating of aluminum oxide thereon. A blade is positioned closely adjacent to roller 110 to remove the positively charged particles therefrom. The particles removed from roller 110 are received by a helical auger 116. Helical auger 116 removes the particles from the cleaning apparatus. Cleaning units of this type are described in U.S. Pat. No. 4,999,679 issued to Corbin et al., the relevant portions thereof being hereby incorporated into the present application.

The spots blade member 70 is positioned generally adjacent to photoreceptor 10, transverse to the process direction 12, and in parallel engagement with the width of belt surface 20. By way of example, blade 70 may be a thin polyurethane blade, generally about 1 mm in thickness with a durometer of 80 Shore A. Of course, other blade materials, including hard plastics and metals, with different durometers, or greater blade thickness, may work if the edge of the blade can be maintained within the same ranges of angle of attack and load, as will be described below.

Blade 70 is supported by a blade support assembly 72 including a slotted blade holder 120 and blade fixture 122, adapted to retain the blade in cleaning position. Alternatively, blade 70 could be adhesively secured to blade holder 120. Blade holder is pivotably attached to an adjustable blade fixture 122. Blade fixture 122 secures blade holder 120, so that the spots blade 70 is maintained within the preferred ranges of angle of attack and load, for optimal removal of agglomerate particles from the surface. The angle of attack 124 is defined as the angle at the first contact point of blade 70 with the photoreceptor surface 20. Blade 70 is maintained at a low angle of attack 124 with respect to the photoreceptor, typically in the range of just greater than 0° to approximately 15°. Additionally, the load on the blade is selected to be relatively low, within the range of just greater than 0 gm/cm to approximately 15 gm/cm and preferably within the range of 2.5–8 gm/cm. Minor variations from these ranges may be acceptable, if the functional aspects of the agglomerate cleaning arrangement are retained.

The force that is desirably applied by the blade edge to agglomerates adhering to the photoreceptor 10 is directed approximately parallel to the surface of photoreceptor 10, to create a shearing or chipping force. It will be appreciated that due to the relatively lower forces applied to the agglomerate spot cleaning blade assembly, the agglomerate cleaning blade is substantially non-functional for cleaning residual toner. Agglomerate spot cleaning blades of this type are described in U.S. Pat. No. 5,031,000 issued to Pozniakas et al., and U.S. Pat. No. 4,989,047 issued to Jugle et al., the pertinent portions of which are incorporated by reference herein.

Figure 2:
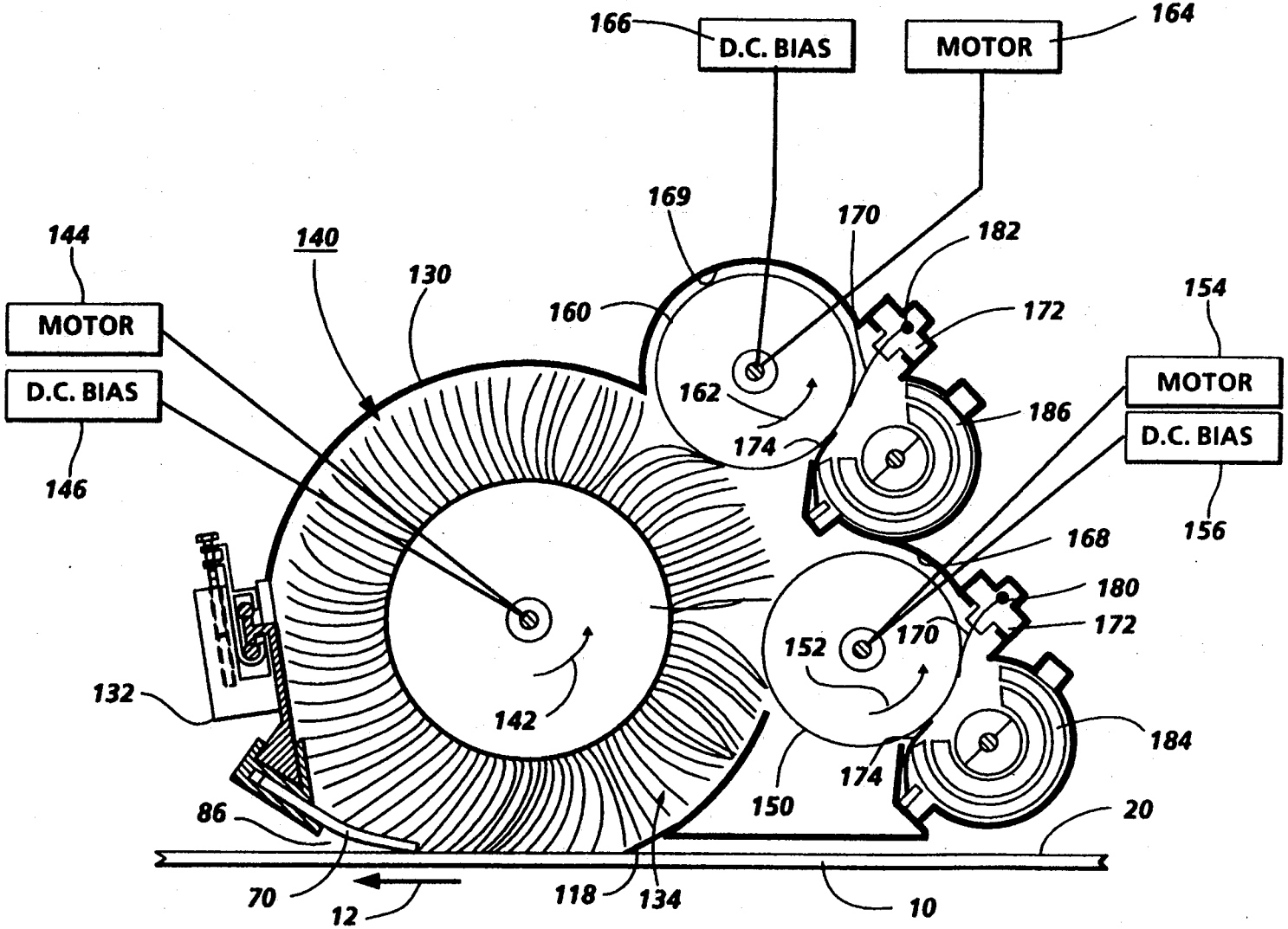
FIG. 2 is an enlarged view of another embodiment of the cleaning station of the present invention.

One skilled in the art will appreciate that variations on the blade support assembly could be used to support the spots blade to the cleaning housing, if a substantially air-flow free environment for removal of accumulated agglomerate debris particles from the spots blade is maintained within the housing. For example, FIG. 2 illustrates another such support assembly that is suitable for use with the cleaning assembly of the present invention. This floating support assembly is disclosed in U.S. Pat. No. 5,031,000 issued to Pozniakas et al., the relevant portions thereof being hereby incorporated into the present application. Such an assembly is loaded with a weight selected to maintain the blade in contact with the charge retentive surface, and floats during the period when a new blade is inserted into a machine, when frictional forces are highest and damage to the surface is likely to occur.

By incorporating the integral location of the spots blade with a substantially enclosed cleaning housing having substantially no net air-flow into and out of the housing, and the contact of the spots blade with both photoreceptor belt surface 20 and cleaning brush 94, the present invention realizes many advantages. The combination of an electrostatic brush and detoning roll with a spots blade in a substantially air-flow free environment, eliminates the need for an air stream or vacuum removal system for aid in transporting toner and/or debris including agglomerate particles from photoreceptor belt to an output. This advantageous feature reduces space requirements within the system, which represents the possibilities of incorporating a smaller machine design, or having more space available for additional features in the system. In certain prior art systems where air removal systems are not used in conjunction with particle removal from spots blades, a separate periodic maintenance step for manual removal of the accumulated agglomerate particles is required. This maintenance step is eliminated by incorporation of the present invention. The elimination of an air stream/vacuum removal system, and/or a manual maintenance step for removing the accumulated agglomerate particles from the spots blade, also represents a significant cost savings.

One skilled in the art will appreciate that variations on the brush used within the cleaning housing, or to the specific bias applied to the brush or roller may be found, if the characteristics of removing and separately storing both "right sign" and "wrong sign" toner particles and debris, including agglomerate particles, from the photoconductive belt surface and spots blade can be achieved.

For example, with reference to FIG. 2 and in accordance with another embodiment of the invention, a cleaning unit may consist of a single fiber brush cleaning arrangement having dual detoning rolls and a spots blade which is integrally attached to cleaning housing by a blade support assembly 132. The spots blade 70 is advantageously positioned immediately adjacent to opening 86 in housing 130, so that the spots blade 70 and support assembly 132 form an integral extension of cleaning housing 130, enclosing the housing in sealing engagement with the photoreceptor belt, wherein a substantially air-flow free environment is maintained. The spots blade 70 is in contact with cleaning brush 140 such that agglomerate particles accumulated by the spots blade are swept by rotating brush fibers 134 and removed with the negatively charged particles from belt 10. A film seal 118 may be incorporated with an embodiment of the present invention to serve as a dirt shield, preventing emissions of residual toner from the cleaning housing. The film seal extends from the cleaning housing 130 to a sealing contact with photoreceptor belt surface 20, thereby closing the gap between housing 130 and photoreceptor belt 10 on the upstream side of the cleaning housing.

A captive fiber cleaning brush 140 is supported for rotational movement in the direction of the arrow 142 via motor 144, within cleaning housing 130, and negatively biased by means of a D.C. power source 146. Brush 140 will remove negatively charged contaminants from the photoreceptor belt surface 20 along with positively charged toner particles to which they may be adhered, by means of a brushing action of the fibers 134 against belt 10 and the electrostatic charge applied to the fibers by means of the D.C. power supply 146. The electrostatic charge and mechanical brushing action of the fibers in contact with the spots blade also removes agglomerate particles accumulated by the spots blade. Brush fibers 134 bearing toner and debris removed from belt 10 and spots blade 70 are first contacted by a first detoning roll 150 supported for rotation in the direction of arrow 152, the same direction as brush 140, by means of a motor 154. An electrical bias is applied to first detoning roll 150 from D.C. power supply 156. A second detoning roll 160 is provided for further removal of the preponderance of residual toner from the brush at a location spaced along the circumference of the brush. A motor 164 drives the roll in the direction of the arrow 162, the same direction as fiber brush 140 and roll 150. An electrical bias is supplied to the roll 160 from a source of D.C. power 166. The bias level on the detoning rolls may be selected to obtain optimum attraction of debris. In a working embodiment of the described cleaning arrangement, the cleaning brush 140 is biased to a potential of about −250 V, while the first detoning roll 150 is biased to about −50 V and the second detoning roll 160 is biased to about −650 V. Thus, only the lightly charged debris, agglomerate particles, and wrong sign toner will be removed from the brush at the first detoning roll for waste removal, while the preponderance of toner will be removed from the second roll for recirculation.

Blade and auger collection arrangements, for the chiseling removal of toner from the detoning rolls and transport of the toner to a storage area or to the developing station, are indicated generally by reference numbers 180 and 182. Collection arrangements 180 and 182 are located within recesses 168 and 169, in cleaning housing 130, provided for the support of the detoning rolls 150 and 160 respectively therein. Accordingly, each detoning roll is provided with an associated cleaning blade 170 supported in chiseling contact with each detoning roll in a molded blade holder 172.

Debris removed by blade and auger arrangement 180 is moved from auger 184 to a storage area for subsequent removal; and toner removed by blade and auger arrangement 182 is moved from auger 186 to developer station for reuse. A film seal member 174 extends towards the blade 170, into contact with the detoning rolls, so that toner or debris chiseled from the detoning roll with the blade is maintained in the area adjacent the blade and auger arrangement. With blade 170, film seal 174 effectively seals the auger arrangement from the remainder of the cleaning station and prevents toner clouds created by the blade and auger from dispersing outside of the blade/auger cavity. Cleaning units of this type are described in U.S. Pat. No. 4,819,026, issued to Lange et al., the pertinent portions of which are incorporated herein by reference.

The invention has been described with reference to a preferred embodiment. Obviously modifications will occur to others upon reading and understanding the specification taken together with the drawings. These embodiments are but examples, and various alternatives, modifications, variations or improvements may be made by those skilled in the art from this teaching which is intended to be encompassed by the following claims.

We claim:

1. A printing machine of the type having a latent image recorded on a surface developed with toner, wherein the improvement comprises:

a housing defining an open end, said housing being positioned with the open end adjacent to the surface;

a brush, rotatably supported within said housing in contact with the surface, for removing toner and debris from the surface; and a blade adapted to remove toner and debris therefrom, said blade being supported on said housing adjacent the open end to form a substantially continuous surface with said housing in a sealing engagement with the surface to maintain a substantially air-flow free environment within said housing.

2. A printing machine according to claim 1, further comprising means for electrically biasing said brush to remove toner of a first magnitude and first polarity from said brush.

3. A printing machine according to claim 1, further comprising detoning means, in contact with said brush, for removal of toner and debris therefrom.

4. A printing machine according to claim 3 wherein said detoning means comprises;

a rotatably supported detoning roll in contact with said brush;

a second blade for removing collected toner or debris from said detoning roll; and auger means for transporting toner and debris removed from the detoning roll by said second blade to a remote location.

5. A printing machine according to claim 1, further comprising:

a second brush in contact with the surface; and means for electrically biasing said second brush to remove toner of a second magnitude and second polarity, opposite to the first polarity, from the surface.

6. A printing machine according to claim 1, wherein said blade comprises a free edge positioned relative to the surface so that forces on the surface shearingly remove spot-causing agglomerate particles from the surface.

7. A printing machine according to claim 6, further comprising an adjustable blade support assembly for pivotably supporting said blade.

8. A cleaning apparatus for removal of spot causing agglomerate particles from a surface, comprising:

a housing defining an open end, said housing being positioned with the open end adjacent to the surface;

a brush, rotatably supported within said housing in contact with the surface, for removing toner and debris from the surface; and a blade adapted to remove toner and debris therefrom, said blade being supported on said housing adjacent the open end to form a substantially continuous surface with said housing in a sealing engagement with the surface to maintain a substantially air-flow free environment within said housing.

9. A cleaning apparatus according to claim 8, further comprising a means for electrically biasing said brush to remove particles of a first magnitude and first polarity from said brush.

10. A cleaning apparatus according to claim 8, further comprising a detoning means, in contact with said brush for removal of particles therefrom.

11. A cleaning apparatus according to claim 10 wherein said detoning means comprises a rotatably supported detoning roll in contact with said brush, a second blade for removing particles from said detoning roll, and auger means for transporting particles removed from the detoning roll by said second blade to a remote location.

12. A cleaning apparatus according to claim 8, further comprising:

a second brush in contact with the surface; and means for electrically biasing said second brush to remove toner of a second magnitude and second polarity, opposite to the first polarity, from the surface.

13. A cleaning apparatus according to claim 8, wherein said blade comprises a free edge positioned relative to the surface so that forces on the surface shearingly remove particles from the surface.

14. A cleaning apparatus according to claim 13, further comprising an adjustable blade support assembly for pivotably supporting said blade.

* * * * *